US005786035A

United States Patent [19]

Nakao et al.

[11] Patent Number: 5,786,035

[45] Date of Patent: Jul. 28, 1998

[54] METHOD FOR PRODUCING METAL-CERAMIC COMPOSITE MATERIALS

[75] Inventors: Yasuhiro Nakao; Kunitoshi Sugaya, both of Saitama-ken, Japan

[73] Assignee: Honda Giken Kogyo Kabushiki Kaisha, Tokyo, Japan

[21] Appl. No.: 507,727

[22] Filed: Jul. 26, 1995

[30] Foreign Application Priority Data

Jul. 28, 1994 [JP] Japan ..... 6-177178
Aug. 3, 1994 [JP] Japan ..... 6-182586

[51] Int. Cl.[6] ..... B05D 1/18

[52] U.S. Cl. ..... 427/443.2; 427/431; 427/248.1

[58] Field of Search ..... 427/248.1, 431, 427/443.2; 164/97, 98

[56] References Cited

U.S. PATENT DOCUMENTS 5,150,747 9/1992 Burke ..... 164/97

FOREIGN PATENT DOCUMENTS 0187194 7/1996 European Pat. Off. .
765423 1/1957 United Kingdom .
770401 3/1957 United Kingdom .
1041137 9/1966 United Kingdom .
1206586 9/1970 United Kingdom .
2079324 1/1982 United Kingdom .
2112813 7/1983 United Kingdom .

OTHER PUBLICATIONS

Bunshah et al. "Deposition Technologies for Films and Coatings, Developments and Applications", Noyes Publications (1992) p. 96.

*Primary Examiner*—Roy V. King
*Attorney, Agent, or Firm*—Weiner, Carrier, Burt & Esser, P.C.; William F. Esser; Joseph P. Carrier

[57] ABSTRACT

Disclosed is a method for producing metal-ceramic composite materials, comprising setting a porous shaped material of an oxide-type ceramic and magnesium in a furnace; establishing a rare gas atmosphere, subliming the magnesium under heat, and dispersing the resulting magnesium vapor into the porous shaped material all within the furnace; introducing nitrogen gas into the furnace, causing the gas to react with the sublimed magnesium to form magnesium nitride ($Mg_3N_2$), bringing the magnesium nitride into contact with the oxide in the surface of the porous shaped material thereby reducing the oxide and exposing metal atoms at the material surface, and thereafter infiltrating a molten metal into the porous shaped material.

17 Claims, 6 Drawing Sheets

METHOD FOR PRODUCING METAL-CERAMIC COMPOSITE MATERIALS

BACKGROUND OF THE INVENTION

1. Field of the Invention

The present invention relates to a method for producing integrated metal-ceramic composite materials and an apparatus for carrying out the method.

2. Description of the Related Art

It is possible to integrate different materials into a composite material having the advantages of the constitutive materials.

Recently, metal-ceramic composite materials to be produced by integrating metals and ceramics are specifically referred to examples of composite materials of this kind.

To produce such metal-ceramic composite materials, a method has heretofore been proposed for spontaneously introducing a molten metal into a reinforcing ceramic material. According to this conventional method, however, the wettability of the molten metal with the metal ceramic matrix (reinforcing material) is poor. In order to improve the wettability, the surface of the reinforcing material must be previously coated with metal and several hours are needed for integrating the reinforcing material and metal. Therefore, the producibility of the conventional method is poor.

In general, pressure casting is employed at present where a reinforcing ceramic material is set in a mold and thereafter forcedly integrated with a molten metal therein. The above-mentioned pressure casting requires a mold and a pressure device for being carried out. As a result, the whole production apparatus for such pressure casting is large-scaled, which is disadvantageous in terms of the space and the cost.

In addition, since the pressure casting is carried out by applying a molten metal to the reinforcing ceramic material under pressure in a mold, as mentioned above, the volumetric factor of the reinforcing material is varied and it is difficult to obtain planned products with intended dimension accuracy. Still further, it is also difficult to produce large-sized composite materials.

We, the present inventors have made the present invention in order to solve the above-mentioned problems.

One object of the present invention is to obtain metal-ceramic composite materials with improved wettability and high adhesiveness, between the constitutive metal and oxide-type reinforcing ceramic. Another object of the present invention is to obtain metal-ceramic composite materials at low cost by introducing a molten metal into a reinforcing material under ambient pressure without using any large-scaled apparatus.

SUMMARY OF THE INVENTION

A first aspect of the present invention is a method for producing metal-ceramic composite materials, which comprises setting a porous shaped material, such as an oxide-type and/or oxide-based ceramic, etc., and magnesium in a furnace, subliming the magnesium in a rare gas atmosphere therein thereby dispersing the thus-sublimed magnesium in the porous shaped material, introducing nitrogen gas into the furnace so that it reacts with the magnesium to form magnesium nitride ($Mg_3N_2$), which is then contacted with oxide existing in the surface of the porous shaped material to remove oxygen therefrom by reduction, thereby exposing a metal component of the porous shaped material such as Al, etc. render the porous shaped material extremely active, and introducing a molten metal into the thus-activated porous shaped material.

The sublimation of magnesium is conducted under reduced pressure. The molten metal is introduced into the shaped material by capillarity or capillary action. The oxygen concentration in the furnace is 1% or less.

According to the present invention, obtained are metal-ceramic composite materials with improved wettability and high adhesiveness between the constitutive metal and oxide-type ceramic. Such metal-ceramic composite materials are obtained at low cost in comparison to conventional methods, without needing any large-scaled apparatus.

A second aspect of the present invention is an apparatus for producing such metal-ceramic composite materials, which comprises a furnace equipped with a gas-introducing means, a gas-discharging means and a heating means; a setting part for housing therein a porous shaped material of an oxide-type ceramic, a housing part for housing magnesium therein, and a molten metal supply means, all disposed in the furnace; and a moving means for moving either one of the setting part and the molten metal supply means to a different position.

The housing part for housing magnesium is preferably a crucible equipped with a heating means. The setting part and the molten metal supply means are constructed in such a way that the setting part can be moved to the position of the molten metal supply means.

In the furnace, disposed is an openable shielding part, by which the furnace is partitioned into a first chamber and a second chamber. In the first chamber, disposed is the housing part for housing magnesium, while the molten metal supply means is disposed in the second chamber. The setting means for housing therein a porous shaped material is made movable back and forth between the first chamber and the second chamber.

According to the present invention, it is possible to easily and continuously produce high quality metal-ceramic composite materials, and the apparatus itself is simple.

BRIEF DESCRIPTION OF THE SEVERAL VIEWS OF THE DRAWINGS

FIG. 1(A) is an explanatory view showing the condition in the furnace before the start of the integration of the constitutive elements.

FIG. 1(B) is an explanatory view showing the condition in the furnace where Mg has been sublimed.

FIG. 1(C) is an explanatory view showing the condition in the furnace where $N_2$ gas has been introduced.

FIG. 1(D) is an explanatory view showing the condition of a porous shaped material dipped in a molten metal.

FIG. 2(A) is a graph showing the process of the present invention, where the horizontal axis indicates the time of the process.

FIG. 2(B) is a graph showing the relationship between the temperature in a furnace and the time of the process, where the vertical axis indicates the temperature and the horizontal axis indicates the time.

FIG. 2(C) is a graph showing the pressure in the furnace, where the vertical axis indicates the pressure and the horizontal axis indicates the time of the process.

FIG. 2(D) is a graph showing the atmosphere in the furnace, where the horizontal axis indicates the time of the process.

FIG. 3(A) is a graphical view showing the condition of sublimed Mg atoms.

FIG. 3(B) is a graphical view showing the condition of Mg atoms sublimed and bonded to N atoms.

FIG. 3(C) is a graphical view showing the condition of exposed Al atoms due to the bonding of Mg and O.

DETAILED DESCRIPTION OF THE INVENTION

One preferred embodiment of the present invention is described in detail hereinunder with reference to the drawings attached hereto.

The first aspect of the present invention is described, which is directed to a method for producing a metal-ceramic composite material.

Figure 1:
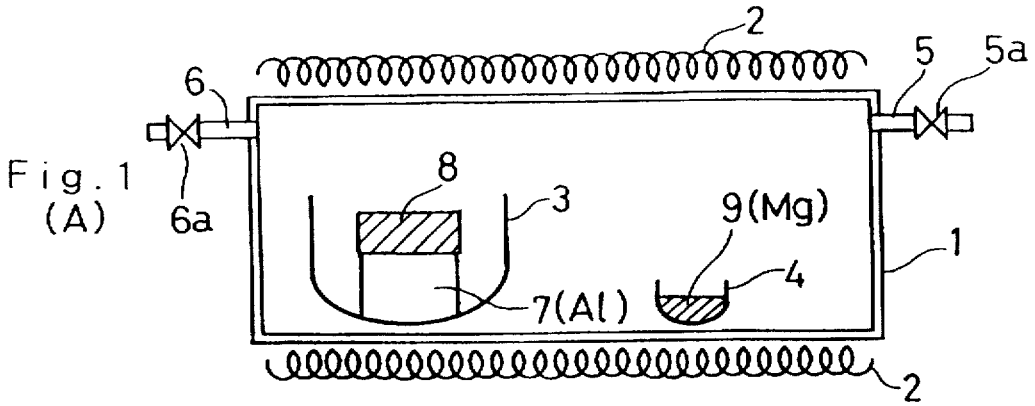
FIGS. 1(A) to 1(D) are graphical longitudinal cross-sectional side views explaining the method of the present invention in order of the steps conducted in a furnace.
Figure 1:
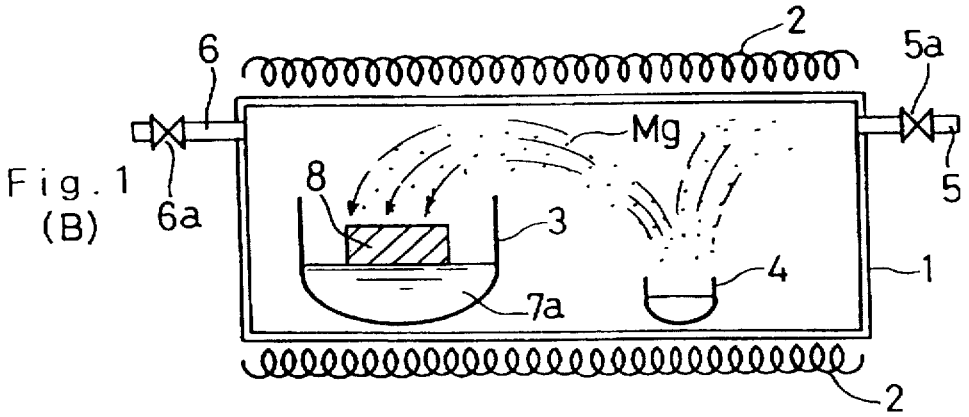
Figure 1:
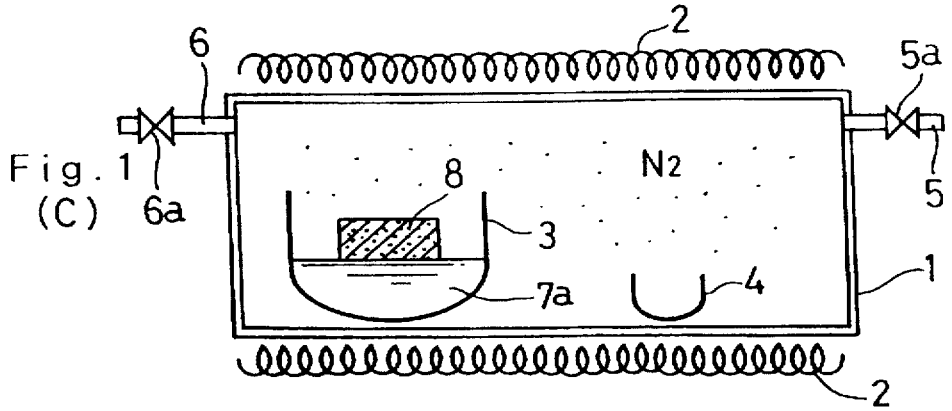
Figure 1:
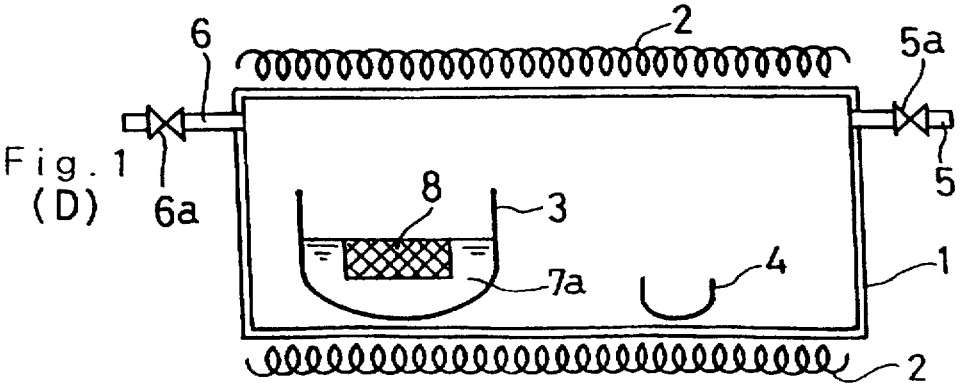

FIGS. 1(A) to 1(D) are graphical longitudinal cross-sectional side views explaining the preferred method of the present invention in order of the steps conducted in a furnace. Precisely, FIG. 1(A) is an explanatory view showing the condition in the furnace before the start of the integration of the constitutive elements. FIG. 1(B) is an explanatory view showing the condition in the furnace where Mg has been sublimed. FIG. 1(C) is an explanatory view showing the condition in the furnace where $N_2$ gas has been introduced. FIG. 1(D) is an explanatory view showing the condition of a porous shaped material dipped in a molten metal.

Figure 2:
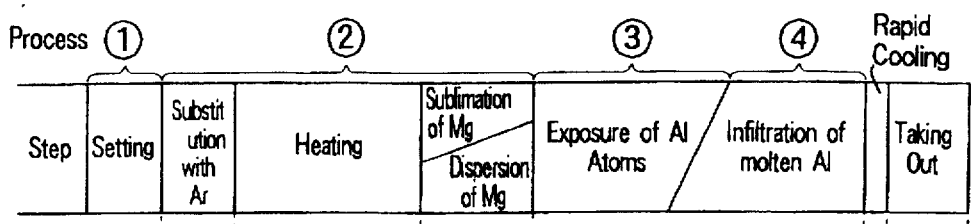
FIGS. 2(A) to 2(D) are graphs explaining the steps of the present invention.
Figure 2:
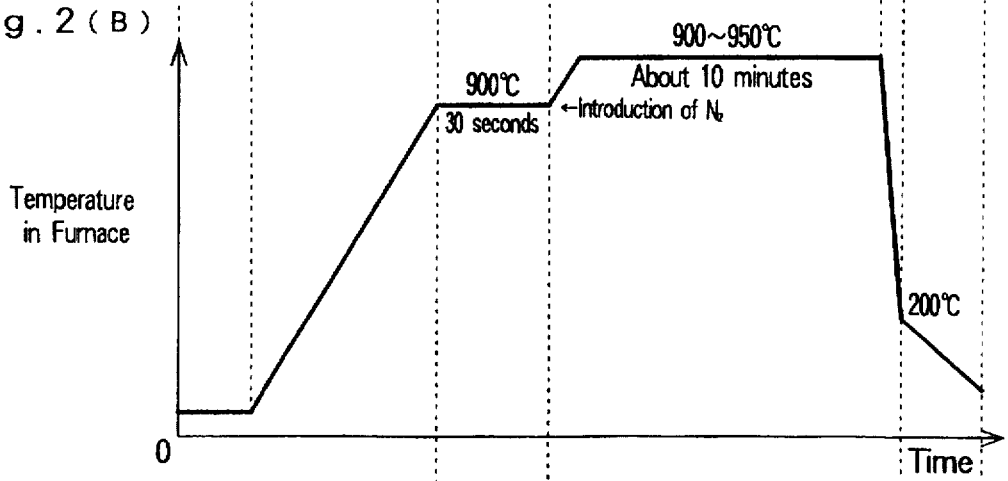
Figure 2:
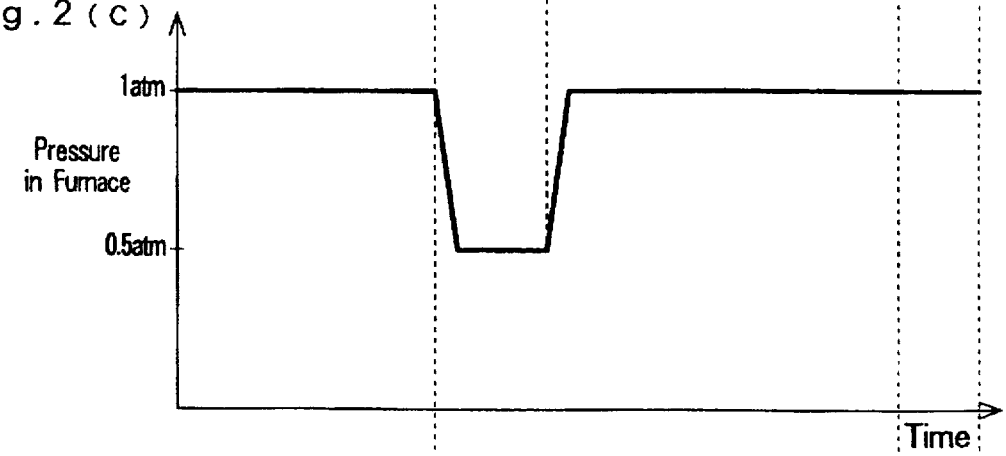
Figure 2:
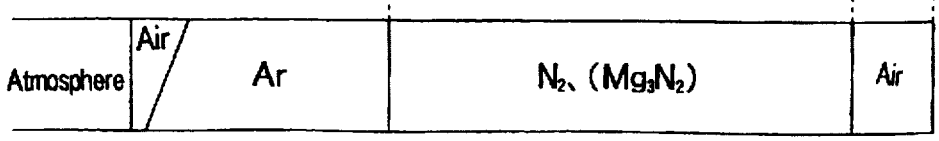

FIGS. 2(A) to 2(D) are graphs explaining the steps of the present invention method. Precisely, FIG. 2(A) is a graph showing the process of the present invention, where the horizontal axis indicates the time of the process. FIG. 2(B) is a graph showing the relationship between the temperature in a furnace and the time of the process, where the vertical axis indicates the temperature and the horizontal axis indicates the time. FIG. 2(C) is a graph showing the pressure in the furnace, where the vertical axis indicates the pressure and the horizontal axis indicates the time of the process. FIG. 2(D) is a graph showing the atmosphere in the furnace, where the horizontal axis indicates the time of the process. These FIGS. 2(A) to 2(D) are laid out in parallel, where the lapse of time indicated by the horizontal axis is the same, by which the present invention is made easy to understand.

Figure 3:
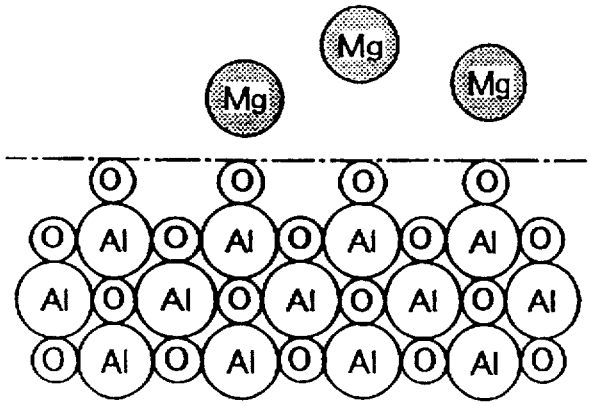
FIGS. 3(A) to 3(C) are graphical views showing the arrangement of atoms.
Figure 3:
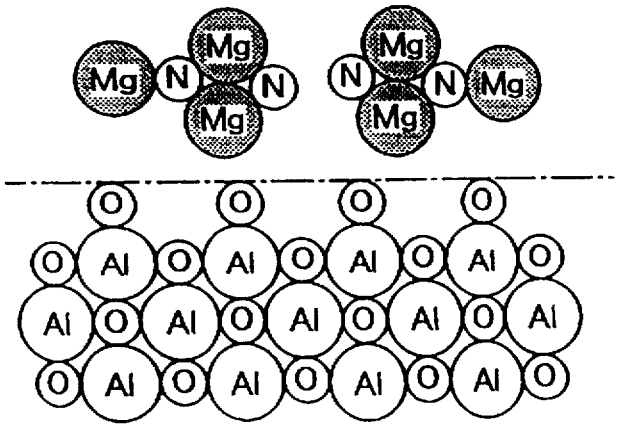
Figure 3:
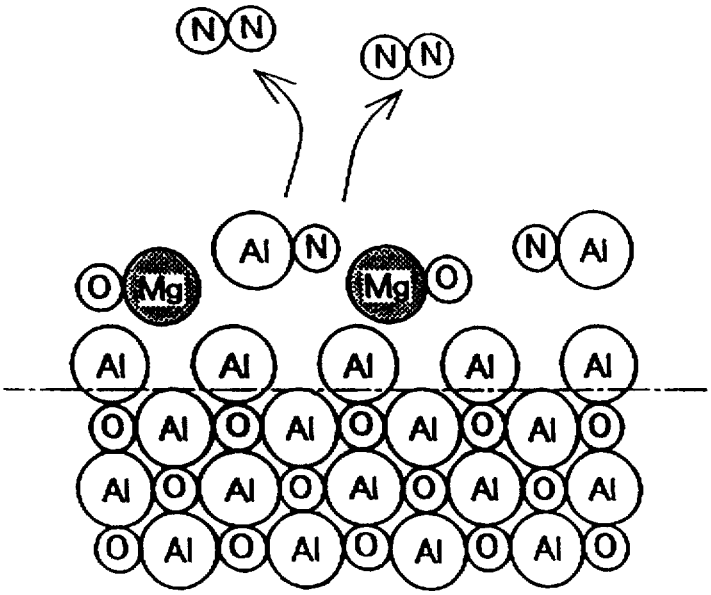

FIGS. 3(A) to 3(C) show atomic arrangement. Precisely, FIG. 3(A) is a graphical view showing the condition of sublimed Mg atoms. FIG. 3(B) is a graphical view showing the condition of Mg atoms sublimed and bonded to N atoms. FIG. 3(C) is a graphical view showing the condition of exposed Al atoms due to the bonding of Mg and O.

Referring to these figures, the method of the present invention is described in detail hereinunder.

In FIGS. 1(A) to 1(D), 1 is a furnace. Heaters 2 are disposed outside the furnace 1, and graphite crucibles 3 and 4 are disposed inside the furnace 1. The furnace 1 is connected with a gas-introducing duct 5 and a gas-discharging duct 6 via a valve 5*a* and a valve 6*a*, respectively.

A pure aluminium (Al) block 7 is set in one crucible 3 in the furnace 1 and a porous shaped material 8 is put on the block 7. A pre-determined amount of magnesium (Mg) 9 is set in the other crucible 4. This condition corresponds to the leftmost site in the graph of FIG. 2(A), which is outside the time-indicating axis. This leftmost site shows the thus-set condition.

The porous shaped material may comprise $Al_2O_3$ fibers or $Al_2O_3$ particles, having a volumetric factor (Vf) of about 20% or so.

Next, as shown in FIG. 1(B), the atmosphere in the furnace 1 is substituted by Ar gas. This is shown in FIG. 2(D) where air in the furnace is substituted by Ar gas.

Next, as shown in FIG. 2(B) indicating the variation in the temperature in the furnace, the temperature in the furnace is elevated up to 900° C. After the temperature has reached 900° C., the pressure in the furnace is reduced down to about 0.5 atms or so, as shown in FIG. 2(C), and the magnesium 9 is completely sublimed at the reduced pressure. The condition of the atoms is shown in FIG. 3(A).

Since the elevated temperature of 900° C. is higher than the melting point of pure Al, the pure Al block 7 is melted to be a molten Al 7*a*. Since the porous shaped material 8 on the molten Al 7*a* contains gas in its texture, the molten Al 7*a* is prevented from penetrating into the material 8 and the material 8 floats on the molten Al 7*a*.

This condition is kept as it is for about 30 seconds, as shown in FIG. 2(B), whereupon the sublimed magnesium vapor is uniformly dispersed inside the porous shaped material 8.

Next, as shown in FIG. 1(C), the graph in FIG. 2(B) and the graph in FIG. 2(C), nitrogen gas is introduced into the furnace 1 until the inner pressure in the furnace 1 becomes 1 atm. Accordingly, the nitrogen gas is reacted with the sublimed magnesium to give magnesium nitride ($Mg_3N_2$). The condition of the atoms in this step is shown in FIG. 3(B).

This condition is kept as it is for about 10 minutes at 900° C. to 950° C., as shown in FIG. 2(B). Accordingly, the thus-formed magnesium nitride ($Mg_3N_2$) is contacted with $Al_2O_3$ formed in the surfaces of the fibers or particles constituting the porous shaped material 8, whereby the oxide is reduced and the Al atoms are exposed out. The condition of the atoms in this step is shown in FIG. 3(C).

The reactions occurring in the furnace are shown below.

$$3Mg\ (gas)+N_2=Mg_3N_2$$

$$2Mg_3N_2+2Al_2O_3=2AlN+6MgO+2Al+N_2$$

$$Mg_3N_2+2Al_2O_3+3Mg=2AlN+6MgO+2Al$$

Since ΔG (Gibbs standard energy formed) in these reaction formulae is negative and the reactions go toward the right, O atoms are released from $Al_2O_3$ in the presence of $Mg_3N_2$.

As mentioned above, since O atoms are released from $Al_2O_3$ and the Al's remained are extremely active, the wettability between the material 8 and the molten Al 7*a* is such that the wetting angle is about 0° (zero degrees) in a spread wet condition. Under the active condition, the molten Al 7*a* penetrates into the porous shaped material 8 within a short period of time and the material 8 sinks in the molten Al 7*a*, as shown in FIG. 1(D).

Since the porous shaped material is fibrous, the molten Al 7*a* penetrates rapidly through the fine voids surely into the depths of the material due to capillarity. Even when the porous shaped material comprises particles, it becomes more porous due to the above-mentioned treatment and the molten Al penetrates rapidly and surely through its surface into the depths of the material also due to capillarity.

After being rapidly cooled to 200° C., the material is taken out of the furnace. The material thus obtained is an extremely dense metal-ceramic composite material filled with pure Al to its depths.

Figure 4:
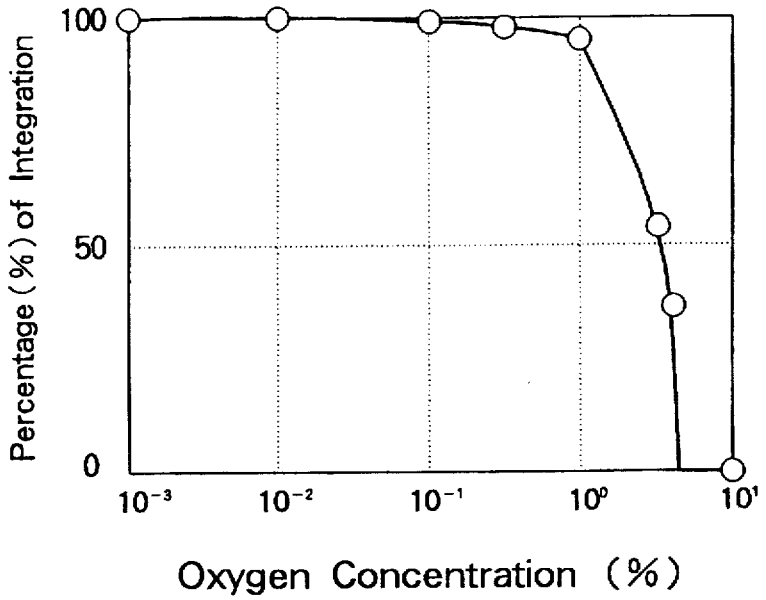
FIG. 4 is a graph showing the relationship between the percentage of integration and the oxygen concentration in a furnace, where the vertical axis indicates the percentage of integration and the horizontal axis indicates the oxygen concentration.

Table 1 below and FIG. 4 show the relationship between the oxygen concentration in the furnace and the percentage of integration. For the graph of FIG. 4, the vertical axis indicates the percentage of integration and the horizontal axis indicates the oxygen concentration.

As is understood from the table and the graph, it is desirable that the oxygen concentration be as low as possible.

If the oxygen concentration is not higher than 1%, the percentage of integration is 90% or more, which is sufficient.

TABLE 1

| Oxygen Concentration | | Percentage of Integration |
|---|---|---|
| $atmO_2$ | % | % |
| $1 \times 10^{-5}$ | $1 \times 10^{-3}$ | 100 |
| $1 \times 10^{-4}$ | $1 \times 10^{-2}$ | 100 |
| $1 \times 10^{-3}$ | $1 \times 10^{-1}$ | 100 |
| $1 \times 10^{-3}$ | $5 \times 10^{-1}$ | 95 |
| $1 \times 10^{-2}$ | $1 \times 10^{0}$ | 85 |
| $1 \times 10^{-2}$ | $5 \times 10^{0}$ | 55 |
| $1 \times 10^{-1}$ | $1 \times 10$ | 0 |

*The percentage of integration indicates the percentage of the integrated part (Al-infiltrated part) in the volume of the preform.

Table 2 below shows the degrees of integration of Al alloys comprising pure Al and Mg and other elements with the matrix. From Table 2, it is known that the amount of Mg to be added to the porous shaped material is suitably from 1 to 14% by weight but preferably from 4 to 14% and that Ca, Si and Cu are not integrated with the matrix.

TABLE 2

| Element | Amount Added (%) | Integration | Remarks |
|---|---|---|---|
| Mg | 1–4 | Δ | The degree of integration is proportional to the amount of Mg added. |
| | 4–14 | o | This range is the best. |
| | 14 or more | o | MgO whiskers are formed. |
| Ca | 1–9 | x | Integration does not occur. |
| Si | 1–10 | x | Integration does not occur. |
| Cu | 1–5 | x | Integration does not occur. |

One embodiment of the method of the present invention has been illustrated hereinabove, in which the porous shaped material was set on the pure Al block and then the block was melted whereby the molten pure Al was made to naturally penetrate into the depths of the porous shaped material. Apart from this embodiment, another embodiment, which will be illustrated hereinunder with reference to the apparatus of the present invention, is also possible where a molten pure Al is prepared in a different place and this is poured onto a porous shaped material of which the surface has been activated by reduction.

According to the method of the present invention illustrated hereinabove, magnesium nitride ($Mg_3N_2$) is brought into contact with the oxide existing in the surface of the porous shaped material comprising an oxide-type reinforcing ceramic material to thereby remove the oxygen atoms from the oxide by reduction, by which the metal atoms such as Al atoms, etc. are exposed and the resulting porous shaped material is thus extremely activated, and thereafter the molten metal is made to penetrate into the depths of the thus-activated porous shaped material. Therefore, it is possible to obtain a metal-ceramic composite material with improved wettability and high adhesiveness between the metal and the oxide-type ceramic material.

According to the present invention, the capillarity of molten metal into the porous shaped material is promoted and it is possible to make the molten metal penetrate into the depths of the porous shaped material within an extremely short period of time. Therefore, the present invention does not required any conventional pressuring means for introducing the molten metal into the porous shaped material under pressure.

Since the present invention does not require any conventional pressure means for introducing the molten metal into the porous shaped material under pressure, any large-scaled apparatus is unnecessary for the invention and it is possible to obtain good metal-ceramic composite materials at low costs according to the invention.

Next, the second aspect of the present invention is described in detail hereinunder, which is directed to an apparatus for producing metal-ceramic composite materials.

Figure 5:
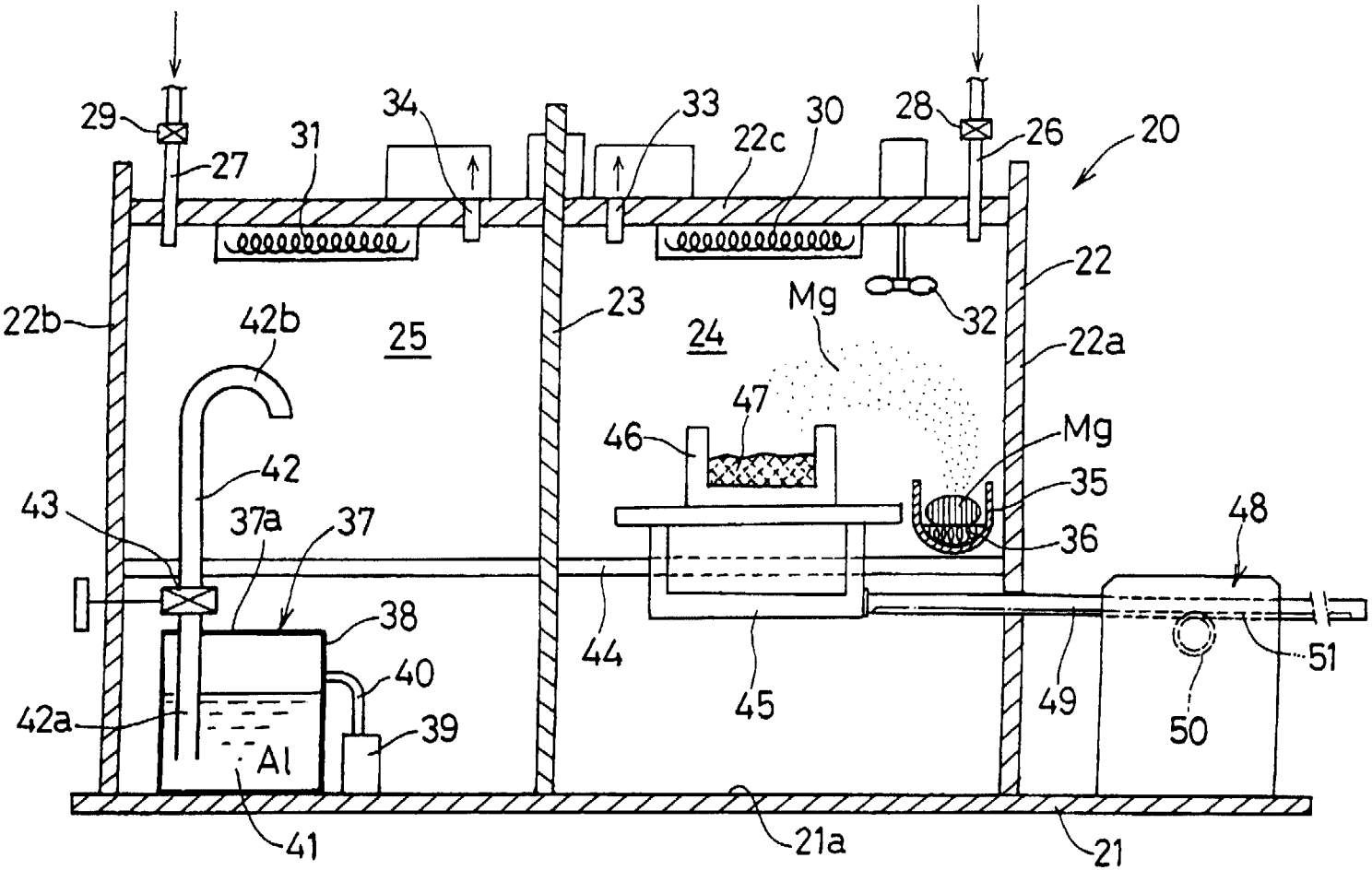
FIG. 5 is a longitudinal cross-sectional side view of the apparatus of the present invention for producing a metal-ceramic composite material, where the first chamber and the second chamber have been partitioned.
Figure 6:
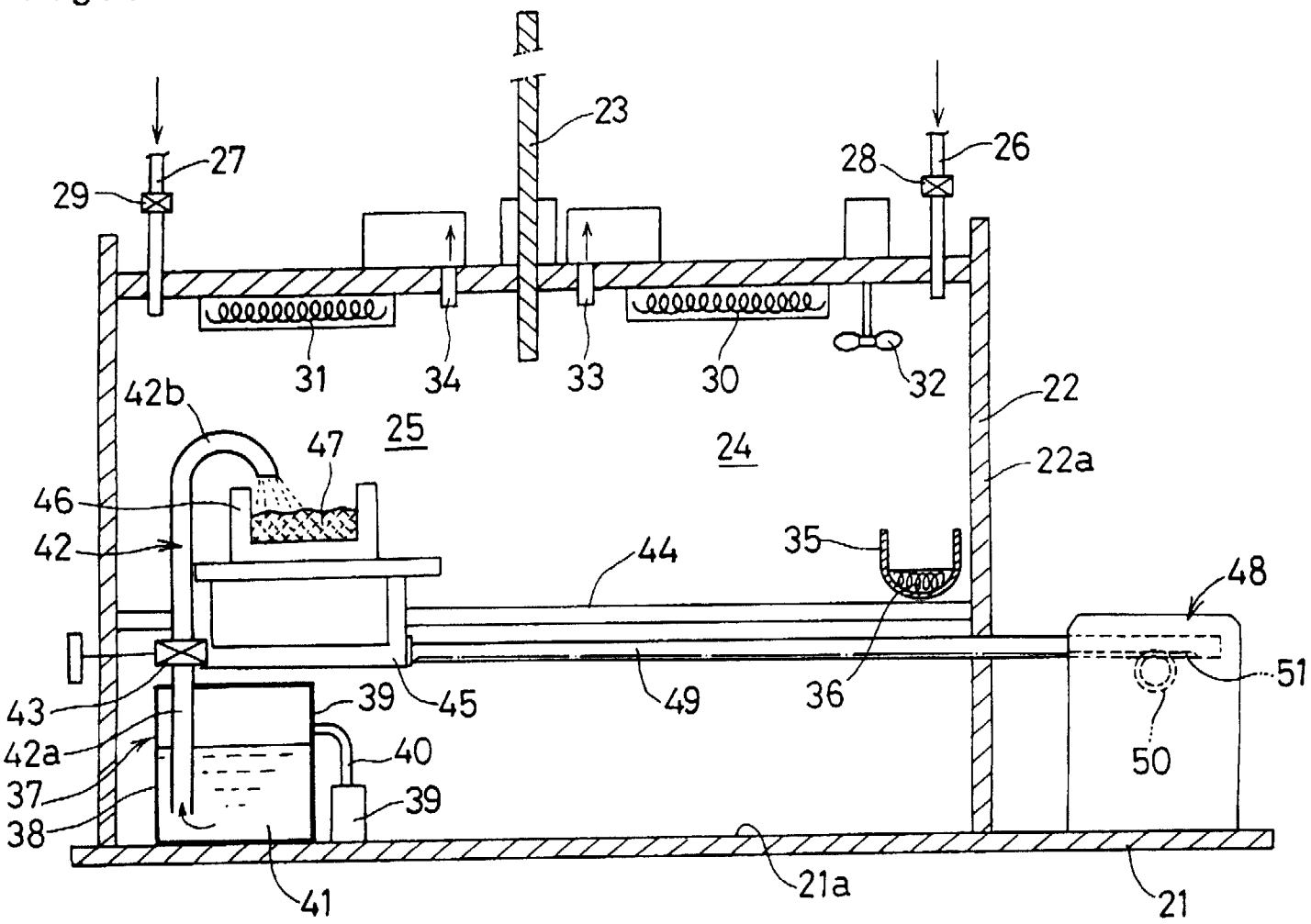
FIG. 6 is a longitudinal cross-sectional side view of the apparatus of FIG. 5, where the first chamber has been made to communicate with the second chamber.

FIG. 5 and FIG. 6 each show a longitudinal cross-sectional side view of the apparatus of the present invention. In FIG. 5, a first chamber and a second chamber have been partitioned. In FIG. 6, the first chamber has been made to communicate with the second chamber.

The apparatus 20 has an air-tightly closed furnace 22 on a table 21. The furnace 22 is constructed by front and back walls **22*a* and 22*b*, side walls (not shown—although the inside wall is seen in the drawings but is not referred to as its code number) and a ceiling 22*c*, which is mounted on the table 21**.

The mouth through which the raw materials are supplied into the furnace 22 is not shown, but, for example, it may be positioned in the front side in the direction penetrating through the paper.

The furnace 22 is partitioned into a first chamber 24 which is in the right of the drawings and a second chamber 25 which is in the left of the drawings, by a tabular shielding part 23.

The shielding part 23 is movable up and down by an elevator means (not shown). By driving the elevator means, the shielding part 23 is moved up and the first chamber 24 is made to communicate with the second chamber 25, as shown in FIG. 6.

The shielding part 23 as set in the furnace prevents the Mg vapor generated in the first chamber 24, as much as possible from invading the second chamber 25. It is not always necessary to air-tightly separate the first chamber 24 and the second chamber 25. Therefore, the shielding part is not always required to be tabular but may be a curtain or the like.

Through the ceiling **22*c* of the first chamber 24 and the second chamber 25, provided are gas-introducing ducts 26 and 27, respectively. These gas-introducing ducts 26 and 27 are provided with valves 28 and 29**, respectively, by which the introduction of gas into the chambers is controlled.

Heaters 30 and 31 are provided at the ceiling **22*c* in the first chamber 24 and the second chamber 25, by which the furnace is heated. A fan 32 for stirring the atmosphere in the furnace is provided at the ceiling in the first chamber 24**.

Through the ceiling 22c of the first and second chambers 24 and 25, provided are exhaust ducts 33 and 34 each connected with a vacuum suction device.

A crucible 35 is set in the first chamber 24. Mg is put in the crucible 35. The crucible 35 is equipped with a heater 36 at its bottom by which Mg in the crucible 35 is sublimed. In place of the heater, an electronic beam generating device may be provided.

A molten metal supply means 37 is set in the second chamber 25. The molten metal supply means 37 is disposed on the floor surface 21a, and this has a closed container 38. The closed container 38 keeps therein a pure molten metal 41 such as Al. The closed container 38 is connected to an inert gas supply source 39 via a duct 40.

Through the closed container 38, provided is a molten metal supply pipe 42. The pipe 42 is inserted into the container 38 in such a way that the lower half thereof is in the container 38 while the lower part 42a is dipped in the molten metal 41 and that the upper half thereof protrudes upward from the upper surface 37a of the container while the upper part 42b is bent in the form of an inverted U-shape. The molten metal supply pipe 42 is provided with a valve 43 at its middle, which is operable outside of the furnace.

The molten metal 41 in the closed container 38 is pushed out via the supply pipe 42 due to the pressure of the inert gas from the inert gas supply source 39.

A rail 44 is provided, which passes between the first chamber 24 and the second chamber 25. The rail 44 passes through the front wall 22a of the furnace 22 and through the shielding part 23, and its end is held by the inner surface of the back wall 22b.

The rail 44 laid in the furnace in the back and forth direction is engaged with a moving bed 45, which is guided and moved by the rail 44. An open setting case 46 is mounted and fixed on the moving bed 45. A porous shaped material 47 of an oxide-type ceramic such as that mentioned hereinabove is placed into the setting case.

The moving bed 45 is connected to one end of a rod 49 which is moved back and forth by a driving device 48 provided outside the front of the furnace 22. The rod 49 is made to penetrate through the front wall 22a of the furnace 22 and is moved back and forth in the right and left direction of the drawings by the driving device 48. The driving device 48 is equipped with a pinion 50 to be driven, for example, by a motor, and the pinion 50 is engaged with the rack 51 provided at the bottom of the rod 49.

Where a composite material is produced, using the apparatus illustrated above, the shielding part 23 is first pull down to partition the first chamber 24 and the second chamber 25. In this condition, magnesium Mg is set in the crucible 35 and a porous shaped material 47 is set in the setting case 46. The porous shaped material 47 used herein preferably comprises $Al_2O_3$ fibers or $Al_2O_3$ particles having a volumetric factor (Vf) of about 20%, such as that mentioned hereinabove.

After this, the atmosphere in the first chamber 24 is substituted by Ar gas via the gas-introducing duct 26 and the exhaust duct 33, and the first chamber 24 thus having an Ar gas atmosphere is heated up to at least 750° C., preferably up to 900° C., while reducing the pressure to 0.5 atms. Accordingly, the magnesium Mg is completely sublimed. The thus-sublimed magnesium Mg vapor penetrates into the porous shaped material 47 in the setting case 46 and adheres uniformly onto the surfaces of the $Al_2O_3$ fibers or $Al_2O_3$ particles constituting the material 47. The condition of the atoms in the chamber 24 is as shown in FIG. 3(A).

The Ar gas substitution of the atmosphere in the first chamber 24 is to remove oxygen gas from the chamber 24. It is desirable that the oxygen concentration in the chamber 24 is as low as possible, as so mentioned hereinabove with reference to FIG. 4.

Next, nitrogen gas is introduced into the chamber 24 until the inner pressure in the furnace 22 becomes 1 atm, which nitrogen gas is reacted with the sublimed Mg to form magnesium nitride ($Mg_3N_2$) in the surfaces of the $Al_2O_3$ fibers or $Al_2O_3$ particles. The condition of the atoms in the chamber 24 is as shown in FIG. 3(B).

Next, the chamber 24 is kept at least 800° C., preferably at 900° C. to 950° C., for 10 minutes, as so mentioned hereinabove, and the magnesium nitride ($Mg_3N_2$) formed is brought into contact with $Al_2O_3$ formed in the surfaces of the $Al_2O_3$ fibers or $Al_2O_3$ particles whereby the metal atoms (Al's) are exposed out.

The reactions conducted in the furnace are as mentioned hereinabove. After the above-mentioned process, 0 atoms are released from $Al_2O_3$ and liquid Al and AlN with good wettability are formed in the surfaces of the $Al_2O_3$ fibers or $Al_2O_3$ particles.

After this process, the shielding part is elevated and the first chamber 24 is made to communicate with the second chamber 25, as shown in FIG. 6. Then, the moving bed 45 is moved from the first chamber 24 to the second chamber 25 by driving the driving device 48. In the illustrated embodiment, the pinion 50 is rotated by driving a motor, and the rod 49 is moved in the lefthanded direction in the drawing via the rack 51 engaged with the pinion 50 whereby the moving bed 45 engaged with the rail 44 is moved.

By this movement, the setting case 46 on the moving bed 45 is positioned below the upper part 42b of the molten metal supply duct 42 disposed in the corner of the second chamber 25. Then the valve 43 is opened, and the molten metal 41 is poured over the porous shaped material 47 in the setting case 46.

Since the liquid Al and AlN with good wettability have been formed in the surfaces of the $Al_2O_3$ fibers or $Al_2O_3$ particles constituting the porous shaped material 47, the molten Al poured over the material is immediately taken in the material 47 by spontaneous penetration of the molten Al into the material and the integration of the metal and the ceramic material is promptly realized.

In the illustrated embodiment, only one combination of the setting case 46 and the moving device is provided, but it is possible to provide two combinations of these in such a way that one setting case is positioned in the first chamber 24 where the process of infiltrating Mg vapor into the porous shaped material in the case is carried out, while the other setting case is positioned in the second chamber 25 where a molten metal is poured over the porous shaped material of which the surface has been already activated in the case.

Using the construction comprising such two combinations, the running efficiency of the apparatus can be elevated.

According to the apparatus of the present invention described above, it is possible to quickly infiltrate the molten metal into the depths of the porous shaped material by spontaneous penetration of the molten metal into the material in the absence of pressure, etc., and it is possible to easily and continuously produce a metal-ceramic composite material having an extremely high percentage of integration. The apparatus itself is simple.

While the invention has been described in detail and with reference to specific preferred embodiments thereof, it will be apparent to one skilled in the art that various changes and modifications can be made therein without departing from the spirit and scope thereof.

We claim:

1. A method for producing a metal-ceramic composite material, comprising the steps of:

setting a porous shaped material of an oxide-based ceramic and magnesium in a furnace;

within the furnace establishing a rare gas atmosphere, subliming the magnesium under heat, and dispersing the resulting magnesium vapor into the porous shaped material;

introducing nitrogen gas into the furnace such that it reacts with the sublimed magnesium to form magnesium nitride ($Mg_3N_2$), followed by bringing the magnesium nitride into contact with the oxide in a surface of the porous shaped material thereby reducing the oxide and exposing metal atoms; and thereafter infiltrating a molten metal into the porous shaped material.

2. The method for producing a metal-ceramic composite material as claimed in claim 1, wherein the magnesium is sublimed in the rare gas atmosphere under ambient pressure.

3. The method for producing a metal-ceramic composite material as claimed in claim 1, wherein the molten metal is infiltrated into the porous shaped material by capillarity.

4. The method for producing a metal-ceramic composite material as claimed in claim 1,, wherein oxygen concentration in the furnace where the magnesium is sublimed is maintained at 1% or less.

5. The method for producing a metal-ceramic composite material as claimed in claim 1, wherein the step of infiltrating the molten metal into the porous shaped material is conducted by dipping the porous shaped material in the molten metal to thereby make the molten metal penetrate into the material.

6. The method for producing a metal-ceramic composite material as claimed in claim 1, wherein the step of infiltrating the molten metal into the porous shaped material is conducted by pouring the molten metal over the porous shaped material to thereby make the molten metal penetrate into the material.

7. The method of producing metal-ceramic composite material as claimed in claim 2, wherein oxygen concentration in the furnace where the magnesium is sublimed is maintained at 1% or less.

8. The method of producing a metal-ceramic composite material as claimed in claim 1, wherein the step of infiltrating the molten metal into the porous shaped material includes moving the porous shaped material from a first portion of the furnace at which said nitrogen gas is introduced to a second portion of the furnace near the molten metal, and contacting outer surfaces of the porous shaped material with the molten metal.

9. A method for producing a metal-ceramic composite material according to claim 8, including a step of separating said first and second portions of the furnace by a moveable partition.

10. A method for producing a metal-ceramic composite material as claimed in claim 1, wherein said infiltrating step is conducted at substantially atmospheric pressure.

11. The method as recited in claim 5, wherein said dipping step comprises the steps of placing the porous shaped material onto a surface of the molten metal prior to said nitrogen gas introducing step and thereafter allowing the porous shaped material to sink into the molten metal.

12. The method as recited in claim 1, further including the steps of separating the molten metal from a portion of the furnace in which the magnesium is sublimed and the nitrogen gas is introduced, during said magnesium subliming step and said nitrogen gas introducing step.

13. The method as recited in claim 1, further including the step of separating the molten metal from a portion of the furnace in which the nitrogen gas is introduced, during said nitrogen gas introducing step.

14. The method as recited in claim 1, further including the step of separating the molten metal from a portion of the furnace in which the magnesium is sublimed, during said magnesium subliming step.

15. The method as recited in claim 12, further including the step of moving the porous shaped material from the first furnace portion to the molten metal prior to said molten metal infiltrating step.

16. The method as recited in claim 13, further including the step of moving the porous shaped material from the first furnace portion to the molten metal prior to said molten metal infiltrating step.

17. The method as recited in claim 14, further including the step of moving the porous shaped material from the first furnace portion to the molten metal prior to said molten metal infiltrating step.

* * * * *

UNITED STATES PATENT AND TRADEMARK OFFICE

CERTIFICATE OF CORRECTION

PATENT NO. : 5,786,035

DATED : 28 July 1998

INVENTOR(S) : Yasuhiro Nakao, Kunitoshi Sugaya

It is certified that error appears in the above-indentified patent and that said Letters Patent is hereby corrected as shown below:

On the cover page, under "[56] References Cited", correct the date of FOREIGN PATENT DOCUMENT 0187194 from "7/1996" to --7/1986--.

Column 1, line 65, before "render" insert --to--.

Column 4, line 59, change "Al's remained" to --Al atoms remaining--.

Column 6, line 18, change "required" to --require--.

Column 7, line 47, change "pull" to --pulled--.

Column 8, line 2, change "is" to --be--.

Column 9, line approximately 26 (claim 4, 2nd line), delete the second comma.

Signed and Sealed this

Twenty-sixth Day of October, 1999

*Attest:*

Q. TODD DICKINSON

*Attesting Officer*

*Acting Commissioner of Patents and Trademarks*